US006093491A

United States Patent [19]

Dugan et al.

[11] Patent Number: 6,093,491

[45] Date of Patent: Jul. 25, 2000

[54] MOISTURE TRANSPORT FIBER

[75] Inventors: Jeffrey S. Dugan, Asheville; John A. Hodan; James R. Lisk, Jr., both of Arden, all of N.C.

[73] Assignee: BASF Corporation, Mt. Olive, N.J.

[21] Appl. No.: 07/983,002

[22] Filed: Nov. 30, 1992

[51] Int. Cl.[7] ..... D02G 3/00

[52] U.S. Cl. ..... 428/397; 428/373; 428/376; 428/395; 428/400

[58] Field of Search ..... 428/397, 373, 428/376, 374, 395, 398, 400, 480, 913, 224, 252; 264/171, 177.13

[56] References Cited

U.S. PATENT DOCUMENTS

| | | | |
|---|---|---|---|
| 1,773,969 | 8/1930 | Dreyfus et al. | 428/397 |
| 3,121,040 | 2/1964 | Shaw et al. | 428/397 |
| 3,169,089 | 2/1965 | Miller et al. | 428/397 |
| 3,194,002 | 7/1965 | Raynolds et al. | 428/397 |
| 3,425,893 | 2/1969 | Sims | 428/397 |
| 3,607,611 | 9/1971 | Takatsuki et al. . | |
| 3,691,749 | 9/1972 | McKay | 428/397 |
| 4,054,709 | 10/1977 | Belitsin et al. | 428/224 |
| 4,163,078 | 7/1979 | Reinehr et al. | 428/373 |
| 4,180,617 | 12/1979 | Reinehr et al. | 428/397 |
| 4,245,001 | 1/1981 | Phillips et al. | 428/397 |
| 4,361,617 | 11/1982 | Suzuki et al. | 428/397 |
| 4,381,325 | 4/1983 | Masuda et al. | 428/397 |
| 4,515,859 | 5/1985 | De Maria et al. | 428/397 |
| 4,639,397 | 1/1987 | Sato et al. | 428/397 |
| 4,713,289 | 12/1987 | Shiffler | 428/397 |
| 4,770,938 | 9/1988 | Peterson et al. | 428/397 |
| 4,791,026 | 12/1988 | Yoshimoto et al. | 428/397 |
| 4,954,398 | 9/1990 | Bagrodia et al. | 428/397 |
| 5,057,368 | 10/1991 | Largman et al. | 428/397 |

FOREIGN PATENT DOCUMENTS

| | | |
|---|---|---|
| 280998 | 11/1964 | Australia . |
| 63-235515 | 9/1988 | Japan . |
| 1030126 | 5/1966 | United Kingdom . |

*Primary Examiner*—Merrick Dixon

[57] ABSTRACT

A thermoplastic fiber demonstrates moisture wicking properties. The fiber has one or more internal lenghtwise open channels each having an opening and at least one groove having a deepest point, a longest dimension and a mouth. The mouth is defined by moving a line from the deepest point along the longest dimension until the largest convex set is identified. The mouth is at the line segment closing the largest convex set. The mouth has width x wherein the average transverse cross-sectional area of the groove is greater than or equal to $(\pi x^2)/8$. A durable hydrophilic surface modification is assosiated with said channel.

12 Claims, 4 Drawing Sheets

MOISTURE TRANSPORT FIBER

FIELD OF THE INVENTION

The present invention relates generally to synthetic thermoplastic fibers. More particularly, this invention relates to synthetic thermoplastic fibers which transport or wick moisture away from a moisture producing source.

BACKGROUND OF THE INVENTION

As used herein, the term "durable" with reference to surface modification means wicking performance after wet-processing, such as dyeing, or at least ten launderings that is superior to wicking performance without the surface modification.

As used herein, the term "fiber" includes fibers of extreme or indefinite length (filaments) and fibers of short length (staple).

Thermoplastic polymers are widely used as raw materials in making fibers for the textile industry. The preference for a textile material by consumers depends largely upon a perception of comfort in the textile garment. Garments made from natural fibers, like cotton, are generally perceived to be more comfortable than garments made from synthetic fibers, like polyester. The preference for cotton is due, at least in part, to cotton's ability to wick perspiration away from the human body. Synthetic fibers, in contrast, tend to be hydrophobic and resist water absorption and transport, but are quick drying.

Several processes have been employed to overcome the moisture transport deficiencies of synthetic fibers. U.S. Pat. No. 4,954,398 to Bagrodia et al. describes treating grooved polyester fibers to the extent necessary to provide a specified roughness at the bottom of the groove which is a specified amount higher than the roughness outside the groove. According to the patent, the treatment provides fibers with wetting characteristics.

Japanese Kokai Patent Application No. 56-112535 describes the preparation of a water-absorbing fabric made from grooved fibers. The fibers are each made from two or more types of thermoplastic polymers having different solubilities so that one of the polymers is dissolved to leave the remaining thermoplastic polymer with grooves. Each fiber has at least six grooves which are virtually continuous in the fiber and have a specified width, depth and proportion of the fiber's cross-sectional area. The Kokai alludes to hydrophilic properties used in combination with absorbent capacity but does not explain how the combination is achieved or how the wetting capacity increases in the combination. The Kokai notes that the grooves are formed on the surface of the fibers to take advantage of the capillary effect of the grooves, and concludes that the effect of grooves is favorable to the effect of adding a moisture absorbing additive to the fibers.

Groove-containing fibers are also generally known. For example, U.S. Pat. No. 4,639,397 to Sato et al. discloses a thermoplastic polymer fiber intended to mimic silk. The fiber has at least two axially continuous grooves of specified width and depth along its periphery.

U.S. Pat. No. 5,057,368 to Largman et al. discloses a fiber having three or four t-shaped lobes where the legs intersect at a stated angle. The fiber is said to be useful for diverse applications such as filtering, wicking, insulating, etc.

Fibers advertised as moisture wicking are presently available from E. I. DuPont de Nemours & Company as Coolmax™ or Thermax™, Allied Chemical Company as Hydrofil™, and Patagonia as Capilene™. None of those fibers has the novel structure of the present invention.

SUMMARY OF THE INVENTION

The present invention resolves deficiencies in previous wicking fibers with a thermoplastic fiber demonstrating moisture wicking properties that has a fiber surface defining an outer boundary and one or more internal lengthwise open channels, each channel having an opening and at least one groove which has a longest dimension, a deepest point and a mouth. The mouth is defined by moving a line which is perpendicular to the longest dimension from the deepest point along the longest dimension until a largest convex set is defined. The mouth is the line segment closing the largest convex set. The mouth has a width x wherein the average transverse cross-sectional area of the groove is greater than or equal to $(\pi x^2)/8$. A durable hydrophilic surface modification is associated with said channel.

It is an object of the present invention to wick moisture and perspiration away from the human body.

Related objects and advantages of the present invention will become apparent to those ordinarily skilled in the art after reading the following detailed description.

DETAILED DESCRIPTION OF THE INVENTION

Figure 1:
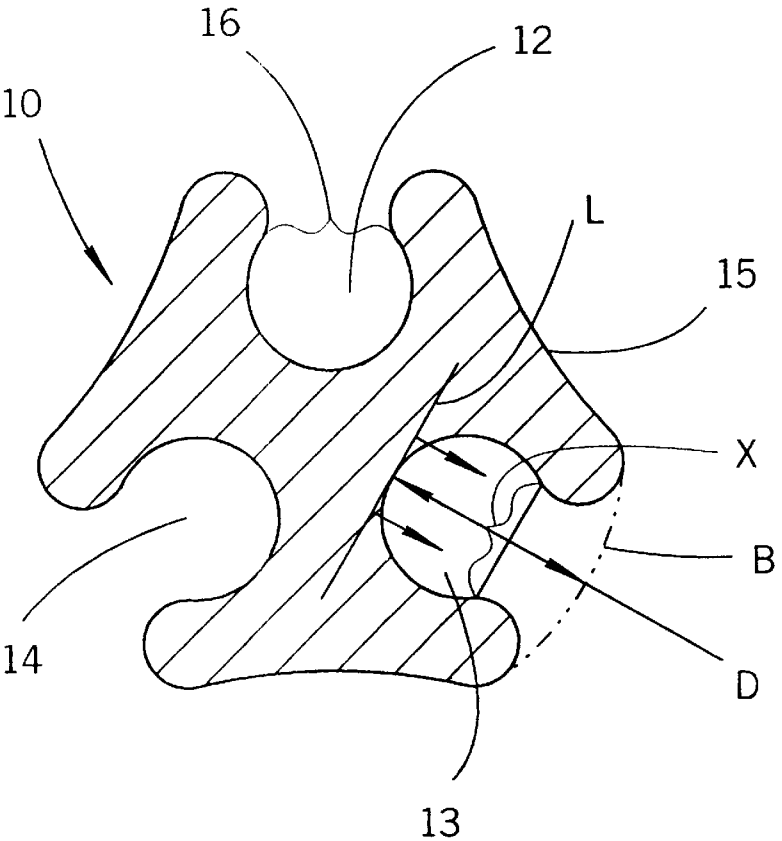
FIG. 1 is a transverse cross-sectional view of a grooved fiber according to an embodiment of the present invention.

To promote an understanding of the principles of the present invention, descriptions of specific embodiments of the invention follow and specific language describes the same. It will nevertheless be understood that no limitation of the scope of the invention is thereby intended, and that such alterations and further modifications, and such further applications of the principles of the invention as discussed are contemplated as would normally occur to one ordinarily skilled in the art to which the invention pertains.

A synergistic effect between a fiber having certain grooves and a hydrophilic surface modification of the fiber has been discovered. The effect may be demonstrated on any thermoplastic fiber, but nylon and polyester fibers are preferred. Typical examples of the polymers that form the thermoplastic synthetic fibers of this invention include polyethylene, polypropylene and other polyolefins, atactic polystyrene, alkyl or hydrogen substituted polystyrene, nylon 6, nylon 6,6, and other polyamides, polyethylene terephthalate and other polyesters formed from copolymerization with polyesters and a third component, etc. The most preferred types of fibers are polyesters and nylon. The fibers made of these polymers may also be in the form of fiber composites or blends of the same type or different types of polymers. The polymers may be extruded according to any known or developed method for extruding polymers of the type. To the polymer may be added various stabilizers, pigments, delustering agents and other additives according to conventional practice.

The fibers of the present invention have at least one, preferably 2 to 8, and maybe more, predominantly continuous channel. The term "channel" means that the fiber cross-section has a specific geometry. The channels may be of various shapes. The channel shape may be semi-circular or almost fully enclosed, so long as the channels remain open to the fibers' environment. A broad variety of channel shapes are possible provided the following conditions are met:

First, the boundary of the channel is selected at the perimeter of the fiber as the segment of the perimeter of the fiber as the perimeter would look if the channels were not present. See B in FIG. 1. Each channel has at least one groove that has a mouth such that the groove's cross-sectional area (A) meets the criteria below. A mouth of the groove is defined by selecting the longest cross-sectional dimension (d) of the groove and moving a straight line (1) which is perpendicular to the longest cross-sectional dimension from the deepest point in the groove along the longest cross-sectional dimension until the largest convex subset of the groove is formed. The mouth is at this point. A convex set or subset is a collection of points such that, for each pair of points in the collection, the entire line segment joining these two points is also in the collection. The mouth has the width x.

Second, the average transverse cross-sectional area (A) of the groove must be greater than or equal to $(\pi x^2)/8$ or $$A \geq \frac{\pi x^2}{8} \qquad \text{Equation 1}$$

Figure 5:
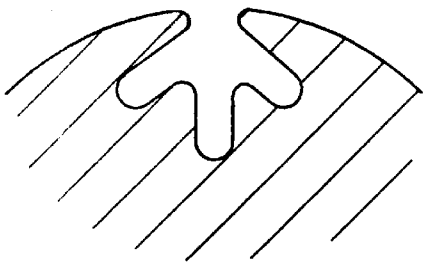
FIGS. 5–8 illustrate, in partial transverse cross-section, alternate channel shapes according to the present invention.
Figure 6:
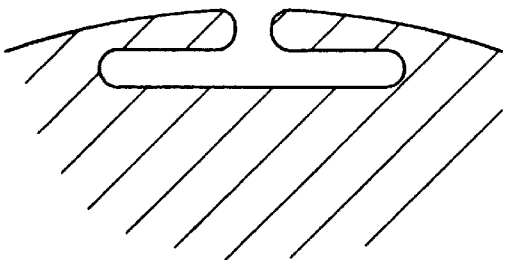
Figure 7:
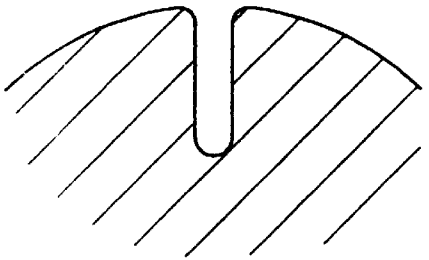
Figure 8:
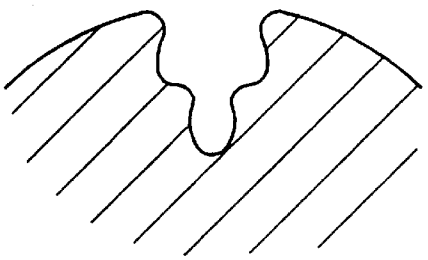

Each channel has at least one groove and may have more. See FIG. 5 where a channel having three grooves is shown. FIG. 6 shows a channel having two grooves. FIG. 7 shows a channel with a co-extensive groove.

A hydrophilic surface modification is associated with each channel. The hydrophilic surface modification may be created in a variety of ways including application of a hydrophilic finish or co-extrusion or grafting of a hydrophilic component with the fiber-forming base polymer. It is preferred that the hydrophilic surface modification is present in the channel and extends at least partially outside the channel to draw moisture into the channel. A variety of materials may impart hydrophilicity to synthetic fibers; but suitable modifiers should be durable. Many sufficiently hydrophilic materials have insufficient affinity to the fiber surface and will, thus, be washed away by the first contact with water. Since the fibers of the invention are likely to be dyed and made into garments which will be laundered, non-permanent materials are unsuitable. Suitable hydrophilic finishes include Milease T™, a sulphonated polyester available from Imperial Chemical Industries ("ICI"), on polyester filaments and Lurotex™, an ethoxylated polyamide (available from BASF Corporation, Parsippany, N.J.), for polyamides.

Without being bound to the theory, it is believed that polyamide based finishes, like Lurotex™ are durable on nylon because they are polyamides, like the nylon they are applied to. With Lurotex™, periodic ethylene oxide groups along the polyamide chain provide hydrophilicity without destroying the polymer's affinity for nylon. To prepare durable hydrophilic finishes for polyamides, hydrophilic groups may be copolymerized into or onto the chain of a polymer which exhibits high affinity for nylon. It is believed that polyester based finishes like Milease T™ add durable hydrophilicity to polyester in the same manner. Other modifiers suitable for polyester include Raycalube PC™ (available from ICI).

The same theoretical approach could be used for other fiber-forming polymers. Polymer chains with affinity to the particular polymer may be modified by copolymerizing with hydrophilic groups. In most cases, this means that the base polymer of the surface modifier will be chemically similar to the fiber polymer. Also, it is contemplated that the base polymer itself could be modified to be hydrophilic. This approach is not preferred because absorption of moisture by the fiber increases drying time.

Several methods are envisioned for applying a surface modifying finish. One option for applying the surface modifying finish is to add the surface modifier to the spin finish. Presently, it is preferred that the modifier is present in the finish sufficiently to add about 0.25% to about 1.0% solids based on the weight of the fiber. Too much surface modifier in the spin finish may interfere with successful drawing. This interference may be reduced when a one-step yarn production process is used.

Another approach to adding the surface modifier is to apply it to the yarn during drawing using a metered finish applicator or a kiss roll. In this case, the modifier is applied on top of the conventional spin finish applied before drawing. For example, 25% Lurotex™ in water has been applied to 40 denier yarn at a draw speed of 627 m/min via a kiss roll operating at 2.8 rpm. Of course, a broad range of conditions are possible according to the surface modifier fiber type and objective.

A third option is to apply the surface modifier during warping. This is done by passing the warp sheet over a kiss roll just ahead of the warp beam and is often called after-oiling or over-oiling. For example, 25–30% Lurotex™ in water has been applied to a warp beam (40 denier yarn, 240 ends) traveling at 300 m/min via a kiss roll operating at 2–4 rpm. Of course, a broad range of conditions are possible according to the surface modifier fiber type and objective.

In none of these three options does the surface modifier interfere with warping, knitting, dyeing or other wet processing of the fabric. However, Milease T™ can be stripped by a carrier in a carrier dyeing process and may leave a white residue in the bath and on the fabric. This is easily prevented by carrierless dyeing.

A fourth option is to apply the surface modifier to the fabric in a wet processing step such as dyeing. For example, 2% Lurotex™ A-25 has been padded on after dyeing.

A fifth option for imparting durable hydrophilicity is to add a hydrophilic material to the fiber polymer in its molten state. This approach relies on physical entrapment of the hydrophilic material inside the fiber polymer for durability. When the modifier is added in the melt, there is potential for degrading the fiber's physical properties. Also, some hydrophilic material is wasted on the inside of the fiber since its activity is required only at the surface. Another reason for not using this approach is that the fiber is more likely to absorb water rather than spreading the water along its surface. An absorbtive fiber takes much longer to dry, resulting in reduced comfort relative to a non-absorbing wicking fiber.

Other methods may be used and are contemplated by the invention. For example, a hydrophilic material may be graft-copolymerized to the surface of the fiber after the fibers are formed. Surface oxidation and plasma treatment are also considered as alternate ways to make the fiber surface hydrophilic.

The hydrophilic surface modification may also be accomplished through co-extrusion of the hydrophilic polymer within the channel and extending to the external fiber surface. Exemplary hydrophilic polymers suitable for co-extrusion include poly N,N-dimethylacrylamide and blends with polyamide or PET; C-68 (a random copolymer of two hexamethylene diamine, two parts caprolactam, one part sodium of sulfonated isophthalic acid and one part isophthalic acid); poly(dioxa-amide) and copolymers with polyamides as described in U.S. Pat. No. 4,130,602; polyamide polyethylene oxide copolymer; polyamide/polyhydroxyethyl methacrylate copolymer; polyamide/Quinazdine dione copolymer, and others.

The fibers of the invention may be texturized according to conventional texturizing methods, for example, crimping, if desired.

The fibers of this invention may be of various deniers from micro-deniers (<1) to very large deniers. No upper limit on denier is conceived since extremely large filaments would be effective if they have sufficient grooves. Presently preferred deniers are about 1 denier per filament to about 10 denier per filament.

Turning now to the figures, FIG. 1 illustrates a representative fiber of the present invention. Fiber 10 has three open channels 12, 13 and 14, and external surface 15. External surface 15 is that portion of the fiber's surface that would be present whether or not the fiber was grooved. Each open channel has a groove with a mouth 16 of a width x. Width x may be the same or different for all the channels of a single fiber.

Figure 2:
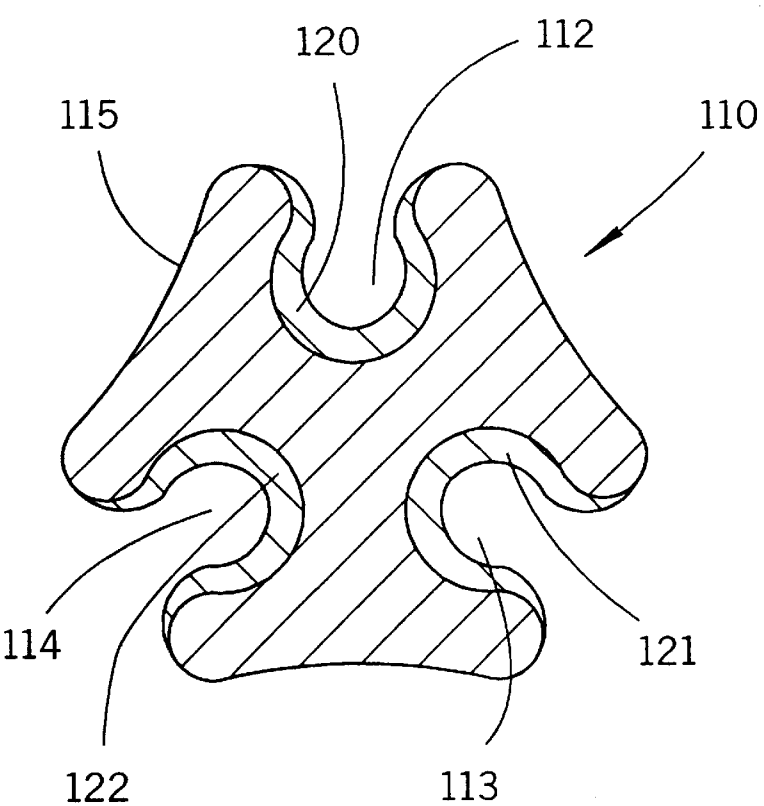
FIG. 2 is a transverse cross-sectional view of another embodiment of the present invention.

FIG. 2 illustrates another embodiment of the present invention wherein the surface is modified through co-extrusion. Fiber 110 has three open channels 112, 113 and 114. Co-extruded polymer coatings 120, 121 and 122, respectively, line each open channel. Each coating extends to external surface 115.

Figure 3:
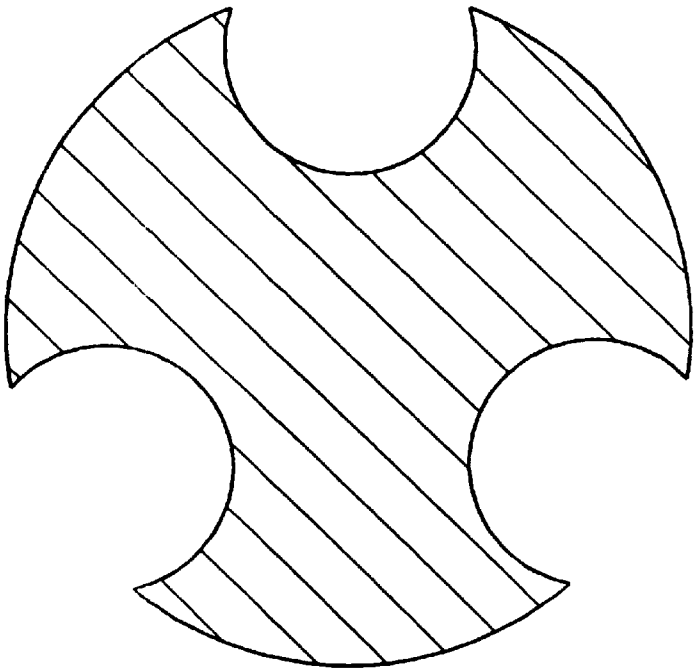
FIG. 3 is a transverse cross-sectional view of yet another embodiment of the present invention.

FIG. 3 illustrates another fiber shape of the present invention having semi-circular open channels.

Figure 4:
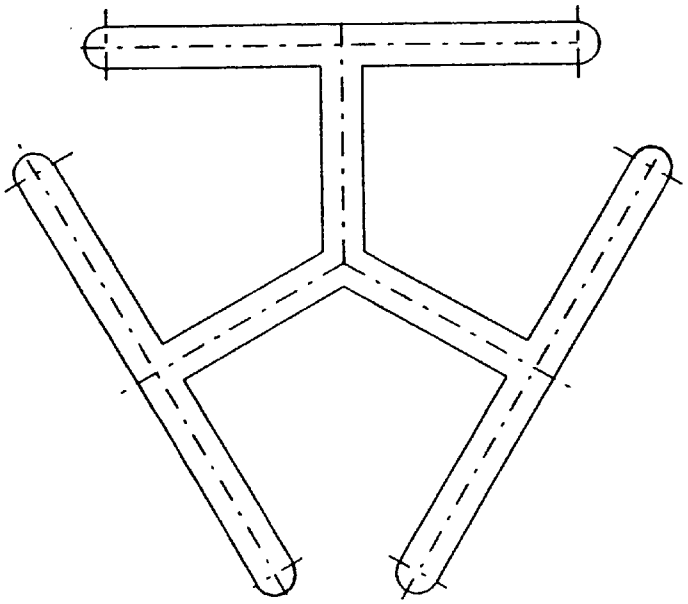
FIG. 4 is a spinneret capillary design useful for extruding fibers of the present invention.

FIG. 4 illustrates a spinneret useful for making the fiber cross-section shown in FIG. 1.

FIGS. 5–8 are partial cross-sectional view illustrating several alternate channel shapes.

Figure 9:
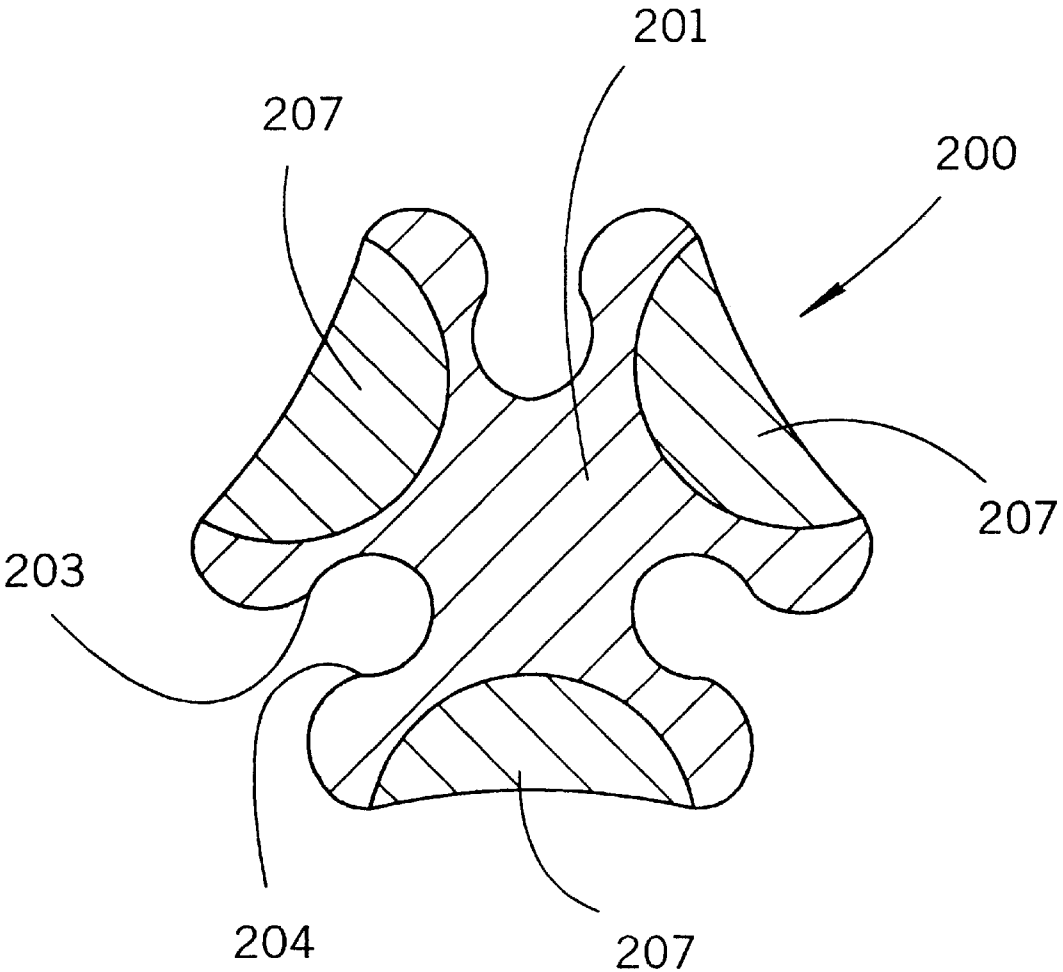
FIG. 9 is a transverse cross-section of an alternate arrangement for the embodiment shown in FIG. 2.

FIG. 9 illustrates an alternate cross-section for a bicomponent filament. Filament 200 is composed of two components. Component 201 is hydrophilic and makes up the core of filament 200 as well as defining the channels walls 203 and 204. Component 201 also extends to the outer perimeter of filament 200 as shown. Component 207 is hydrophobic or the base polymer such as nylon 6 or polyester. Component 207 defines most of the external surface of filament 200.

METHODS

Wicking Capacity:

Wicking capacity is determined by vertical wicking test methods. For vertical wicking tests, one end of a fabric is placed in water. The time required for the water to rise in the fabric above the water line is measured. For knit tubes, the time to wick ½ inch is determined. The distance wicked in 5 minutes is measured for warp knit fabrics.

In general, poor wicking performance is that exhibited by raw PET. For vertical wicking tests, ½ inch wicking in 30 seconds or less is considered good for nylon 6 (40/12 denier) and polyester terephthalate (70/24 denier) which are single end circular knit on a FAK knitting machine with the knit stitch set at 3.1.

Wicking capacity is somewhat dependent on the knitting style, denier and other characteristics of the fabric being measured.

Drop Absorbency:

For drop absorbency, a single drop of water is dropped onto a horizontal fabric and the time for the droplet to be entirely absorbed into fabric is measured. To do this, the fabric sample is mounted tautly in an embroidery hoop in a standard atmosphere having a relative humidity of 65±2% at 70°±2° F. (21°±1° C.). The hoop and fabric are placed between an observer and a light source at an angle that allows the specular reflectance of light from a liquid drop to be plainly seen. Using a dropper, one drop of colored water solution (10 g red food color in 500 cc distilled water) is dropped on the fabric from a height of 1 cm. A timer is started and not stopped until the specular reflectance of the drop is lost. The time is recorded in seconds.

In general, less than 5 seconds is considered excellent absorbency. The average absorbency time for bleached cotton is 2.5 seconds. Drop absorbency depends on fabric construction. For example, in the following examples warp knits had generally better drop absorbencies than knit tubes. For 40/12 denier nylon 6, 30 seconds or less is good drop absorbency and for polyester terephthalate (70/24 denier) 60 seconds or less is good drop absorbency, where the fabrics measured are single-end circular knits made on a FAK knitting machine with the knit stitch set on 3.1.

Cross-Section:

Fiber cross-sections are verified by microscopic evaluation.

EXAMPLES

Fibers are made using a standard melt-spinning process.

Melt-Spinning Process:

Nylon

Nylon 6 chips (relative viscosity=2.7 as measured in $H_2SO_4$) are fed into an extruder, which melts the polymer and delivers it at 275° C. via a metering pump operating at 8.8 g/min through a series of filters to the back side of a spinneret. Pressure from the metering pump forces the molten polymer through holes in a 12-hole spinneret. These holes are shaped to produce the desired cross-section in the fiber. The molten polymer stream ejected from the spinneret hole passes in front of a stream of cool, dry air flowing at 66 ft/min. The quench air re-solidifies the polymer at a controlled rate, locking in the fiber cross-section. The now-solid fiber passes over a kiss wheel finish applicator operating at 200 sec/25 revolutions on the way to the wind-up device. The finish applied to the fiber typically is an oil-in-water emulsion which includes lubricants, antistatic agents, and emulsifiers. The fiber is then wound up at 850 m/min.

After winding the yarn, the yarn package is transferred to a drawing station. Here the yarn is unwound from the package and, using a series of rollers running at different speeds, is drawn at a draw ratio of 2.65. The drawing speed is 2050 ft/min. The spindle speed is 7600 rpm.

This process is known as a two-step process because two distinct steps are involved. It is contemplated that a one-step process can be used. The one-step process may be preferable because of process efficiencies.

Polyester

Polyethylene terephthalate (relative viscosity=0.625–0.655) chips are fed into an extruder which melts the polymer and delivers it at 290° C. via a metering pump operating at 18.6 g/min through a series of filters to the back side of a spinneret. Pressure from the metering pump forces the molten polymer through holes in a 24-hole spinneret. These holes are shaped to produce the desired cross-section in the fiber. The molten polymer stream ejected from the spinneret hole passes in front of a stream of cool, dry air flowing at 80 ft/min. The quench air re-solidifies the polymer at a controlled rate, locking in the fiber cross-section. The now-solid fiber passes over a metered finish applicator operating at a pump speed of 0.045 $cm^3$/min on the way to the wind-up device. The finish applied to the fiber typically is an oil-in-water emulsion which includes lubricants, antistatic agents and emulsifiers. The fiber is then wound up at 850 m/min.

After winding the yarn on the core, the yarn package is transferred to a drawing station. Here the yarn is unwound from the package and, using a series of rollers running at different speeds, is drawn in two stages. The first stage draw ratio is 1.0089 and the second stage draw ratio is 2.80. The drawing speed is 2050 ft/min. The spindle speed is 8800 rpm. After drawing, the yarn is again wound around a cylindrical core. This is called a two-step process because two separate steps are involved.

It should be understood by those of ordinary skill in the art that modifications of this process can be used to make the fiber of the present invention.

A modification of the two-step process above is the one-step process. In the one-step polyester process, the yarn is drawn between the spinneret and the winder by winding at higher speeds than in the two-step process. This modification requires that the yarn be externally heated in the drawing zone, and that fiber entanglement occur prior to winding.

In general, the two-step process is used but the one-step process is used where indicated. Of course, modification of either the one-step or two-step process may be used as will be apparent to those who are ordinarily skilled in the art.

Surface modification is applied as described above and as shown in the tables below.

Dyeing:

Nylon:

Nylon samples are first scoured and then dyed on a Bentley-Pegg beam machine which has a volume (with no cloth) of 73 gallons or 276 liters by the atmospheric acid dyeing method. The cycle is set for inside-out flow for 3 minutes and outside-in flow for 6 minutes. All rinses are inside-out. The machine is filled and the pumps are started and pressurized. The bath is set at 110° F. (43.3° C.) with 2.0% of an oxyethylene based leveling agent (Uniperol® NB-SE available from BASF Corporation), 0.2 g/l trisodium phosphate and 4.0 g/l of an acid donor (Solvocine® NK, dihydro-1(3H)-furanone from BASF Corporation) and allowed to run for 15 minutes. At this time, the pH is checked and adjusted to 9.5–10.0 with trisodium phosphate. The dyes (0.5% C.I. Acid Blue 25) are added and run for 10 minutes. The temperature is adjusted to 200° F. (94° C.) and the samples are run for another hour. The sample is checked for shade and the pH is again checked. The bath is allowed to cool to 180° F. (82° C.) and the overflow rinse is depressurized until the bath is cold and fairly free of dye. At 110° F. (44° C.), the sample is rinsed for 10 minutes. The sample is again rinsed at 110° F. (44° C.) for 10 more minutes with 1.0% acetic acid 28% (on weight of fiber ("owf")). The sample is unloaded and extracted.

Polyester:

Carrier Dyeing:

Polyester fabrics are pressure beam dyed on a Bentley-Pegg beam machine. The machine is loaded, filled and pressurized. The bath is set at 120° F. (50° C.) and 2.0% of a phosphate ester dye-leveling agent (Tanapal® ME from Sybron Chemicals Inc.); 1.0% acetic acid 28%; and 0.25% of a chelating agent (Versene 100®, a ethylenediaminetetraacetate from BASF Corporation) are added to the bath. The machine is allowed to run for 5 minutes. 4.0% carrier (Tanavol®) is added to the bath. It is run for 10 more minutes at 120° F. (50° C.) then the dye formula (1.2% Terasil Blue GLF) is added and it is allowed to run for 5 additional minutes. The temperature is adjusted to 265° F. (130° C.) and the bath is run for 60 minutes. The bath is allowed to cool to 200° F. (94° C.). It is then cooled to 180° F. (82° C.). The sample is rinsed for 10 minutes at 160° F. (71° C.). The sample is afterscoured for 15 minutes at 160° F. (71° C.) and pressurized as follows: 0.5% surfactant (Dupanol® RA, an alcohol ether sulfate sodium salt available from DuPont); 4.5 g/lb dicyclohexyl anionic surfactant (1% Aerosol A-196 available from American Cyanamid Co.) (added to cold bath); 9.0 g/lb 2% NaOH (added to cold bath); and 14.0 g/lb 3% sodium hydrosulfite (add dry when temperature has reached 150° F.). The sample is rinsed at 100° F. (38° C.) for 10 minutes with 2% acetic acid, rinsed with cold water and extracted.

Carrierless Dyeing:

This method is the same as above except no carrier (Tanavol®) is used.

Washing:

The samples are subjected to the following wash procedure:

The samples are washed in a Sears Kenmore 600 home laundry washer with the following machine setting:

Water level: Low

Water temperature: Warm

Machine setting: Delicate cycle

Second rinse: Off

The concentration of Tide® detergent in the wash is 0.36 g/liter (15 g in 11 gallons water).

The liquid-to-cloth ratio is 30 to 1. Woven cotton sheeting pieces approximately 0.8×0.8 meter are used to bring the total weight to approximately 1400 g.

The complete procedure of the washing machine is as follows for the delicate cycle wash that is used:

a) fill with water at 49±3° C. (11 gallons);

b) wash 8 minutes at the "slow" speed of the agitator (48 cycles/min);

c) drain;

d) centrifuge for 2 minutes, during which time four 5-second sprayings with fresh water are applied at 49° C.;

e) fill with fresh water at 49° C. (11 gallons), soak for 2 minutes after filling;

f) agitate 2 minutes at slow speed;

g) drain; and h) centrifuge 4 minutes.

The rinsing is described in steps d), e) and f) above.

The water contains 8–12 ppm hardness and a trace of chlorine (less than 0.5 ppm). The pH is 7.3–7.5.

After completing the required number of wash cycles, the samples are removed and dried in a Kenmore Model 110 electric dryer for approximately 20 minutes at a temperature of 110–130° F.

When creased or wrinkled, the specimens are pressed lightly on the wale side, using a warm (approximately 60–70° C.) iron.

Examples 1–8

Polyester Comparative Examples—Without Surface Modification Knit Tube

Polyester yarn is made from filaments as described above. These filaments had from zero to at least 4 channels and no surface modifiers were used. The deniers and cross-sections are as shown in TABLE 1. The yarn is made into knit tubes, some are greige and some are carrier-dyed. Vertical wicking and drop absorbency is measured and reported in TABLE 1.

Wicking performance on greige goods may be due to residual spin finish emulsifier which washed away during dyeing.

TABLE 1

| Exam. No. (Trial) | Polymer | Den/Fil | No. of Channels | Finish Add-On (% owf) | Surface Modifier | Vertical Wicking ½ in. (sec) | Drop Abs. (sec) | |
|---|---|---|---|---|---|---|---|---|
| 1 | PET | 83/14 | 4+/– | 1 | None | 17 | 165 | <greige |
| E-3606 | | | | | | — | — | <dyed |
| 2 | PET | 65/14 | 4+/– | 1 | None | 22 | 156 | <greige |
| E-3606 | | | | | | — | — | <dyed |
| 3 | PET | 44/14 | 4+/– | 1 | None | 23 | 315 | <greige |
| E-3606 | | | | | | — | — | <dyed |
| 4 | PET | 73/24 | 3 | 1 | None | 12 | 60 | <greige |
| E-3689 | | | | | | 180+ | 180+ | <dyed |
| 5 | PET | 68/24 | 0 | 1 | None | 22 | 180+ | <greige |
| E-3731 | | | (round) | | | 180+ | 180+ | <dyed |
| 6 | PET | 68/24 | 3 | 1 | None | 11 | 137 | <greige |
| E-3732 | | | | | | 180+ | 180+ | <dyed |
| 7 | PET | 68/24 | 3 | 1 | None | 38 | 180+ | <greige |
| E-3733 | | | | | | 180+ | 180+ | <dyed |
| 8* | PET | 72/24 | 3 | 1 | None | 14 | 159 | <greige |
| E-3741 | | | | | | 21 | 180+ | <dyed |

*One-step method

Examples 9–10

Polyester Comparative Examples—With Surface Modification Knit Tube

Polyester yarn is made from filaments as described and knit into tubes. Some tubes are carrier-dyed and some are greige. These filaments have no channels but Milease T™ is applied as described in TABLE 2. Vertical wicking and drop absorbency for these samples are reported in TABLE 2.

Milease HPA™ is not sufficiently durable but data is provided here for the sake of comparison.

The application of surface modification during drawing results in variable performance perhaps due to uneven application.

TABLE 2

| Ex. No. | Polymer | Den/Fil | No. of Channels | Finish Add-On (% owf) | Surface Mod. | Surface Mod. App. Method | Surface Mod. Add-On (% owf) | Vert. Wick. ½ in (sec) | Dr. Abs. (sec) | |
|---|---|---|---|---|---|---|---|---|---|---|
| 9 | PET | 68/24 | 0 | 0.75 | Milease | in spin | 0.25 | 7 | 173 | <gre. |
| E-3731 | | | round | | T ™ | finish | | 109 | 124 | <dye. |
| 10 | PET | 68/24 | 0 | 0.5 | Milease | in spin | 0.5 | 7 | 180+ | <gre. |
| E-3731 | | | round | | T ™ | finish | | 108 | 106 | <dye. |

Examples 11–23

Polyester Invention Examples—Knit Tube

Channeled polyester filaments are made as described. Yarn is made from the filaments and the yarn is knit into tubes. Some tubes are dyed and some are greige. Surface modifiers are applied as shown in TABLE 3. Vertical wicking and drop absorbency for these samples are reported in TABLE 3.

TABLE 3

| Ex. No. | Polymer | Den/Fil | No. of Channels | Finish Add-On (% owf) | Surface Mod. | Surface Mod. Add-On Method | Surface Mod. Add-On (% owf) | Vert. Wick ½ in (sec) | Dr. Abs (sec) | |
|---|---|---|---|---|---|---|---|---|---|---|
| 11 | PET | 68/24 | 3 | 0.75 | Milease | in spin | 0.25 | 8 | 60 | <gre |
| E-3732 | | | | | T ™ | finish | | 11 | 30 | <dye |
| 12 | PET | 68/24 | 3 | 0.5 | Milease | in spin | 0.5 | 6 | 82 | <gre |
| E-3732 | | | | | T ™ | finish | | 30 | 16 | <dye |
| 13 | PET | 68/24 | 3 | 1 | Milease | above | 0.25 | 16 | 103 | <gre |
| E-3733 | | | | | T ™ | draw | | 180 | 100 | <dye |
| | | | | | | zone | | | | |

TABLE 3-continued

| Ex. No. | Polymer | Den/Fil | No. of Channels | Finish Add-On (% owf) | Surface Mod. | Surface Mod. Add-On Method | Surface Mod. Add-On (% owf) | Vert. Wick ½ in (sec) | Dr. Abs (sec) | |
|---|---|---|---|---|---|---|---|---|---|---|
| 14 | PET | 69/24 | 3 | 1 | Milease | below | 0.25 | 16 | 122 | <gre |
| E-3733 | | | | | T ™ | draw zone | | 88 | 74 | <dye |
| 15 | PET | 69/24 | 3 | 1 | Milease | above | 0.5 | 14 | 141 | <gre |
| E-3733 | | | | | T ™ | draw zone | | 33 | 63 | <dye |
| 16 | PET | 68/24 | 3 | 1 | Milease | below | 0.5 | 9 | 128 | <gre |
| E-3733 | | | | | T ™ | draw zone | | 25 | 115 | <dye |
| 17 | PET | 70/24 | 3 | 0.75 | Milease | in spin | 0.25 | 12 | 112 | <gre |
| E-3740 | | | | | T ™ | finish | | 13 | 39 | <dye |
| 18 | PET | 70/24 | 3 | 0.75 | Milease | in spin | 0.25 | 8 | 72 | <gre |
| E-3740 | | | | | HPA ™ | finish | | 180+ | 180+ | <dye |
| 19 | PET | 69/24 | 3 | 0.75 | Rayca- | in spin | 0.25 | 32 | 79 | <gre |
| E-3740 | | | | | lube PC ™ | finish | | 180+ | 76 | <dye |
| 20* | PET | 72/24 | 3 | 0 | Milease | in spin | 0.25 | 7 | 52 | <gre |
| E-3741 | | | | | T ™ | finish | | 180+ | 58 | <dye |
| 21* | PET | 72/24 | 3 | 0.75 | Milease | in spin | 0.25 | 8 | 57 | <gre |
| E-3741 | | | | | HPA ™ | finish | | 180+ | 180+ | <dye |
| 22* | PET | 72/24 | 3 | 0.75 | Rayca- | in spin | 0.25 | 8 | 94 | <gre |
| E-3741 | | | | | lube PC ™ | finish | | 11 | 180+ | <dye |
| 23 | PET | 70/24 | 3 | 0.75 | Milease | in spin | 0.25 | 3 | 52 | <gre |
| E-3760 | | | | | T ™ | finish | | 55 | 40 | <dye |

*One-step process

Example 24

PET Comparative Example—Without Surface Modifier Warp Knit

PET yarn is made from filaments as described and warp knitted. Some of the samples are greige and some are carrier-dyed. These filaments have no channels and no surface modifiers. Wicking and absorbency data are reported in TABLE 4.

TABLE 4

| Ex. No. | Polymer | Den/Fil | No. of Channels | Finish Add-On (% owf) | Surface Modifier | Vertical Wicking 5 min (in.) | Drop Abs. (sec.) | |
|---|---|---|---|---|---|---|---|---|
| 24 | PET | 70/24 | 0 | 1 | None | — | 180+ | <greige |
| E-3375 | | | round | | | 0.4 | 180+ | <dyed |

Example 25

PET Comparative Example—Without Channels With Surface Modification Warp Knit PET yarn is made from filaments as described and warp knitted. The fabric is carrier-dyed. These filaments have surface modifiers but no channels. Results of wicking and absorbency testing are reported in TABLE 5.

TABLE 5

| Ex. No. | Polymer | Den/Fil | No. of Channels | Finish Add-On (% owf) | Surface Mod. | Surface Mod. App. Method | Surface Mod. Add-On (% owf) | Vert Wick 5 min (in.) | Dr. Ab. sec | |
|---|---|---|---|---|---|---|---|---|---|---|
| 25 | PET | 70/24 | 0 | 1 | Milease | in pad | 0.25 | — | — | <gre |
| E-3775 | | | round | | T ™ | bath | | 1.8 | 39 | <dye |

Examples 26–27

Invention-Warp Knit

PET filaments are made as described, made into yarn and warp knitted. Some knit fabrics are dyed and some are greige. The filaments have channels and surface modifiers as shown in TABLE 6. Results of wicking and absorbency testing are reported in TABLE 6. In Example 26, where the dyeing is carrierless, performance was retained.

TABLE 6

| Ex. No. | Polymer | Den/Fil | No. of Channels | Fin. Add-On (% owf) | Surface Mod. | Surface Mod. App. Method | Sur. Mod. Add-On (% owf) | Vert Wick 5 min (in) | Dr. Abs. sec. | |
|---|---|---|---|---|---|---|---|---|---|---|
| 26 | PET | 69/24 | 3 | 0.75 | Milease | in spin | 0.25 | — | 1 | <gre |
| E-3775 | | | | | T ™ | finish | | 3.9 | 2 | <dye* |
| 27 | PET | 69/24 | 3 | 0.75 | Milease | in spin | 0.25 | — | 1 | <gre |
| E-3775 | | | | | T ™ | finish | | 1.9 | 20 | <dye |

*carrierless dyeing

Examples 28–30

Comparative Examples Nylon—Without Surface Modification

Nylon yarn is made from filaments with and without channels as described and knit into tubes. No surface modifier is applied. Data for drop absorbency and wicking are reported in TABLE 7.

Wicking performance on greige goods is due to residual spin finish emulsifer.

TABLE 7

| Ex. No. | Polymer | Den/Fil | No. of Channels | Finish Add-On (% owf) | Surface Modifier | Vert. Wick. ½ in (sec.) | Drop Abs. (sec.) | |
|---|---|---|---|---|---|---|---|---|
| 28 | Nylon | 764/14 | 5 | 0.26 | None | 33 | — | <greige |
| | | | | | | — | — | <dyed |
| 29 | Nylon | 81/24 | 3 | 1 | None | 4 | 16 | <greige |
| N-3426 | | | | | | 180+ | 180+ | <dyed |
| 30 | Nylon | 69/24 | 3 | 1 | None | 13 | 33 | <greige |
| N-3797 | | | | | | 180+ | 180+ | <dyed |

Examples 31–39

Invention-Nylon 6 Knit Tube

Nylon yarn is made from filaments with channels as described, surface modified and knit into tubes. Data for drop absorbency and wicking are reported in TABLE 8. Milease T™ and Raycalube™ are not durable surface modifiers for nylon.

TABLE 8

| Ex. No. | Polymer | Den/Fil | No. of Channels | Finish Add-On (% owf) | Surface Mod. | Sur. Mod. App. Meth. | Sur. Mod. Add-On (% owf) | Vert Wick ½ in (sec) | Drop Abs. (sec) | |
|---|---|---|---|---|---|---|---|---|---|---|
| 31 | Nylon | 79/24 | 3 | 0.75 | Milease | in spin | 0.25 | 14 | 53 | <gre |
| N-3705 | | | | | T ™ | finish | | 180+ | 180+ | <dye |
| 32 | Nylon | 78/24 | 3 | 0.75 | Milease | in spin | 0.25 | 10 | 43 | <gre |
| N-3705 | | | | | HPA ™ | finish | | 180+ | 180+ | <dye |

TABLE 8-continued

| Ex. No. | Polymer | Den/Fil | No. of Channels | Finish Add-On (% owf) | Surface Mod. | Sur. Mod. App. Meth. | Sur. Mod. Add-On (% owf) | Vert Wick ½ in (sec) | Drop Abs. (sec) | |
|---|---|---|---|---|---|---|---|---|---|---|
| 33 | Nylon | 79/24 | 3 | 0.75 | Rayca- | in spin | 0.25 | 56 | 72 | <gre |
| N-3705 | | | | | lube PC ™ | finish | | 180+ | 180+ | <dye |
| 34 | Nylon | 70/24 | 3 | 0.93 | Luro- | in spin | 0.25 | 4 | 24 | <gre |
| N-3797 | | | | | tex ™ | finish | | 30 | 28 | <dye |
| 35 | Nylon | 70/24 | 3 | 0.85 | Luro- | in spin | 0.5 | 3 | 26 | <gre |
| N-3797 | | | | | tex ™ | finish | | 19 | 15 | <dye |
| 36 | Nylon | 68/24 | 3 | 0 | Luro- | in spin | 1 | 4 | 17 | <gre |
| N-3797 | | | | | tex ™ | finish | | 20 | 16 | <dye |
| 37 | Nylon | 40/12 | 3 | 0.75 | Luro- | in spin | 0.25 | 5 | 21 | <gre |
| N-4114 | | | | | tex ™ | finish | | — | — | <dye |
| 38 | Nylon | 40/12 | 3 | 0.50 | Luro- | in spin | 0.50 | 4 | 17 | <gre |
| N-4114 | | | | | tex ™ | finish | | — | — | <dye |
| 39 | Nylon | 40/12 | 3 | 1.75 | Luro- | in spin | 0.75 | 4 | 20 | <gre |
| N-4114 | | | | | tex ™ | finish | | — | — | <dye |

Examples 40–41

Comparative Examples-Trilobal Nylon With And Without Surface Modification Warp Knit Trilobal nylon yarn is made from filaments with and without surface modifiers as described and warp knitted. Drop absorbency and wicking data are presented in TABLE 9.

A simple trilobal shape does not provide the magnitude of performance seen with channeled fibers. See Table 10.

TABLE 9

| Ex. No. | Polymer | Den/Fil | No. of Channels | Finish Add-On (% owf) | Surface Mod. | Surface Mod. App. Method | Sur. Mod. Add-On (% owf) | Vert Wick 5 min (in.) | Drop Abs. (sec) | |
|---|---|---|---|---|---|---|---|---|---|---|
| 40 | Nylon | 40/12 | 0 | 1 | None | — | — | — | — | <gre |
| N-4050 | | | tri- lobal | | | | | 0.9 | 180+ | <dye |
| 41 | Nylon | 40/12 | 0 | 1 | Luro- | after | 0.25± | — | — | <gre |
| N-4050 | | | tri- lobal | | tex ™ | dyeing | | 2.1 | — | <dye |

Examples 42–44

Invention-Warp Knit

Nylon filaments with channels and surface modifiers are made as described. Yarn is made from the filaments and the yarn is warp knit. Drop absorbency and wicking data are presented in TABLE 10.

TABLE 10

| Ex. No. | Polymer | Den/Fil | No. of Channels | Finish Add-On (% owf) | Surface Mod. | Surface Mod. App. Method | Surface Mod. Add-On (% owf) | Vert. Wick 5 min (in.) | Dr. Abs sec | |
|---|---|---|---|---|---|---|---|---|---|---|
| 42 | Nylon | 40/12 | 3 | 1 | Luro- | in | 0.25+ | — | 1 | <gre |
| N-3918 | | | | | tex ™ | drawing | | 3.2 | 1 | <dye |
| 43 | Nylon | 40/12 | 3 | 1 | Luro- | over- | 0.25+ | — | 1 | <gre |
| N-4050 | | | | | tex ™ | oiled in warping | | 3.1 | 1 | <dye |
| 44 | Nylon | 40/12 | 3 | 1 | Luro- | over- | 0.25+ | — | 1 | <gre |
| N-4050 | | | | | tex ™ | oiled in warping | | 3.5 | 1 | <dye |

Examples 45–46

Durability on Nylon-Warp Knit

Modified nylon filaments with and without channels are made as described. Yarn is made from the filaments and the yarn is warp knit. The samples are washed 50 times according to the washing procedure. Following washing, wicking is measured and results are reported in TABLE 11.

TABLE 11

| Ex. No. | Polymer | Den/Fil | No. of Channels | Fin Add-on (% owf) | Sur. Mod. | Sur. Mod. App Method | Sur. Mod. Add-On (% owf) | Vert. Wick. 5 min. (in.) | |
|---|---|---|---|---|---|---|---|---|---|
| 45 N-4050 | Nylon | 40/12 | 3 | 1 | Luro-tex ™ | over-oiled in warping | 0.25± | 3.5 | <dyed |
| 46 N-4050 | Nylon | 40/12 | 0 tri-lobal | 1 | Luro-tex ™ | after dyeing | 0.25± | 1.4 | <dyed |

Positive results on greige channeled yarn without surface modifier (Examples 1–8) are attributable to standard spin finish emulsifiers which are in the finish to emulsify hydrophobic oil components. These emulsifiers remain on the yarn, essentially acting as a surface modifier, leaving the polymer surface sufficiently hydrophilic to allow the channels to employ capillary wicking. However, dyeing (or laundering, or scouring, or other exposure to water) strips these water-soluble emulsifiers from the yarn, destroying its moisture transport performance.

Example No. 27 shows the carrier dyeing will strip some Milease T™ from polyester.

What is claimed is:

1. A thermoplastic fiber demonstrating moisture wicking properties comprising:

a) a fiber surface defining an outer boundary and one or more internal lengthwise open channels each having an opening and at least one groove having a longest dimension, a deepest point and a mouth, said mouth defined by moving a line which is perpendicular to said longest dimension from said deepest point along said longest dimension until a largest convex set is defined, said mouth having a width wherein the average transverse cross-sectional area of the groove is greater than or equal to $(\pi(\text{width})^2)/8$; and b) a durable hydrophilic surface modifier associated with said channel.

2. The fiber of claim 1 wherein grooves are semi-circular.

3. The fiber of claim 1 having three open channels.

4. The fiber of claim 1 wherein said surface modification is present in said open channels and extends onto said outer boundary.

5. The fiber of claim 4 wherein said surface modification is durable to wet processing and laundering.

6. The fiber of claim 5 wherein said thermoplastic is polyester and said surface modification is a polyester copolymer or modified polyester.

7. The fiber of claim 6 wherein said modified polyester is sulphonated polyethylene terephthalate.

8. The fiber of claim 6 wherein said sulphonated polyester is supplied as a coating representing 0.1% to 1.5% based on the weight of the fiber.

9. The fiber of claim 5 wherein said thermoplastic is nylon and said surface modification is a polyamide copolymer or modified polyamide.

10. The fiber of claim 9 wherein said modified polyamide is an ethoxylated polyamide.

11. The fiber of claim 8 wherein said ethoxylated polyamide is supplied as a coating representing 0.1% to 1.5% based on the weight of the fiber.

12. The fiber of claim 1 wherein said filament is a bicomponent filament having one component which is nylon or polyester and a second component associated with said channel which is hydrophyllic.

* * * * *